United States Patent [19]

Morse

[11] Patent Number: 4,611,942

[45] Date of Patent: Sep. 16, 1986

[54] SHEET REGISTRATION MEANS

[75] Inventor: John E. Morse, Irondequoit, N.Y.

[73] Assignee: Eastman Kodak Company, Rochester, N.Y.

[21] Appl. No.: 686,101

[22] Filed: Dec. 24, 1984

[51] Int. Cl.[4] ..... B42F 13/00; B42F 13/12

[52] U.S. Cl. ..... 402/79; 402/80 L

[58] Field of Search ..... 402/79, 80 L, 80 R, 402/29; 428/131; 33/184.5; 281/45; 40/376

[56] References Cited

U.S. PATENT DOCUMENTS

| | | | |
|---|---|---|---|
| 935,767 | 10/1909 | Mentzer | 402/79 |
| 1,107,351 | 8/1914 | Proudfit | 402/79 |
| 1,694,647 | 12/1928 | Garfield | 402/79 |
| 2,495,687 | 1/1950 | Belmont | 402/79 |
| 3,318,311 | 5/1967 | Gressette et al. | 402/79 |
| 3,710,457 | 1/1973 | Rechdahl et al. . | |
| 3,970,397 | 7/1976 | Armstrong | 402/79 |

FOREIGN PATENT DOCUMENTS

| | | | |
|---|---|---|---|
| 521358 | 4/1930 | Fed. Rep. of Germany | 402/79 |
| 414545 | 12/1966 | Switzerland | 402/79 |

OTHER PUBLICATIONS

Research Disclosure No. 24717, Nov. 1984 (p. 532).

*Primary Examiner*—Paul A. Bell
*Assistant Examiner*—Paul M. Heyrana, Sr.
*Attorney, Agent, or Firm*—Norman Rushefsky

[57] ABSTRACT

To register a sheet within a plane, a sheet registration means is provided comprising a flap formed on the sheet for resiliently biasing registration edge elements of the sheet against fixed locating pins. A total of no more and no less than three registration edge elements of the sheet are engaged by the locating pins to provide exact location of the sheet in its proper orientation within the plane.

5 Claims, 5 Drawing Figures

SHEET REGISTRATION MEANS

BACKGROUND OF THE INVENTION

1. Field of the Invention

This invention relates to the registration of sheets within a plane so that the sheet may be exactly located in its proper orientation within the plane.

2. Description of the Prior Art

In the prior art there are numerous means proposed for precisely orienting a sheet within a plane. For example, it is known to orient a sheet upon a horizontal surface by registering a corner, or edge of the sheet upon a corner or edge formed on the surface. If the sheet edges are not straight or square with each other, other means must be provided to register the sheet within the plane. Even if the sheet edges are square, it is often desirable to write upon the sheet, or move something upon the sheet Thus, forces are imparted to the sheet and have a tendency to move the sheet from its registered position. To secure the sheet against such movement, it is well known to support the sheet using one or more locating pins wherein the pins project from a surface comprising the plane of registration. The pins extend through one or more apertures formed in the sheet and thereby help to secure against lateral movement of the sheet within the plane.

In U.S. Pat. No. 3,710,457 a stack of answer sheets for use with an automatic grading device is disclosed. The answer sheets are held by a pin which extends through an aperture formed on each of the sheets. The aperture is positioned in a prescribed relationship with an edge of the sheet. Guide bars located against the edge of the sheet cooperate with the pin to prevent rotational movement of the sheet. In the embodiment illustrated in FIG. 8 of this patent, a triangular aperture is formed in the sheet and the aperture is made smaller than the pin which extends through it. A flap is formed in the sheet adjacent to the aperture and the flap deflects as the larger pin enters the smaller aperture. The flap thereby prevents tearing of the sheet as the sheet is mounted on the pin. In this construction for registering the sheet, it will be noted that four edge elements of the sheet are being used to register the sheet. As used herein the term register implies producing a condition of correct alignment or proper relative position within a plane. The four edge elements comprise two edge elements contacted by guide bars engaging an edge of the sheet and two converging edge elements which border the aperture and are engaged by the pin. The use of four distinct edge elements to define position and orientation of a sheet comprises an over-constraint. In a design imposing a condition of over-constraint, there exists the problems of having:

(1) undesired clearance between the sheet being registered and the locating means, i.e., pins and edge guide bars, with attendant uncertainty as to position or orientation of the sheet; or (2) potentially damaging interference between the sheet and the registration aids.

It is therefore an object of the invention to provide a sheet registration means wherein the registration condition of over-constraint and its attendant problems are avoided and wherein a condition of exact constraint exists.

SUMMARY OF THE INVENTION

The invention pertains to an improved sheet registration means including locating means associated with a plane in combination with registration edge elements on a sheet for registering the sheet in the plane, the sheet having one or more flaps formed in the sheet; and the improvement which comprises wherein the one or more flaps cooperate with means external to the sheet for resiliently biasing a total of only three registration edge elements of the sheet against the locating means and wherein the registration edge elements are so oriented relative to each other as to form well separated centers of rotation.

The invention also pertains to sheets that are specially constructed for mounting on pin means so that when mounted a condition of exact constraint exists in defining the registration of the sheet.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
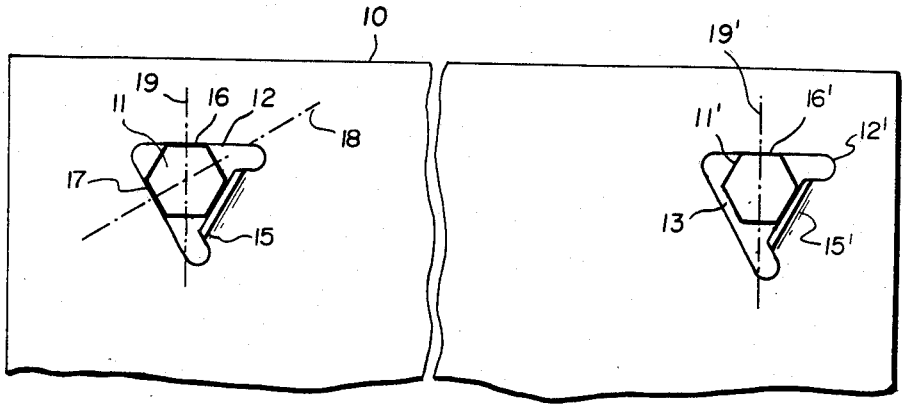
FIG. 1 is a plan view of a portion of a sheet registered by two pins in a condition of exact constraint.
Figure 2:
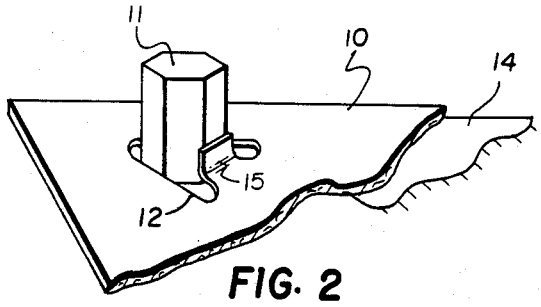
FIG. 2 is a perspective view of a portion of the sheet shown in FIG. 1.

With reference to FIG. 1 a sheet 10 includes identical "A" shaped apertures 12, 12', which are punched or otherwise suitably formed within the sheet. Hex pins 11, 11' extend through the respective apertures. The hex pins may be fixed to a horizontally disposed planar surface 14 upon which the sheet rests. Resilient flaps 15, 15' are integrally formed on the sheet and border or are adjacent the apertures so that when the pins are inserted, the flaps rest upon flats of the hex pins and resiliently urge registration edges 16, 17 and 16' which border the apertures into engagement with other opposed flats formed on the hex pins. As may be noted in FIG. 1, the center to center distance between hex pins 11, 11' is slightly greater than the distance between corresponding points defining the apertures to establish a clearance 13 in one of the apertures so that only one flat of the hex pin 11' engages a registration edge 16' of the aperture 12'. The hex pin 11, it will be noted, engages two converging registration edges 16, 17 of the aperture 12. The hex pins 11 and 11' thereby function as a locating means.

Not counting engagement by the flaps, since they are resilient, the sheet is constrained in total by engagement of only three registration edges 16, 17 and 16'.

To establish a condition of exact constraint it is important that instantaneous centers of rotation arising from the registration condition be reasonably well separated; that is, separated approximately on the general order of the sheet dimensions. An instantaneous center of rotation represents a point about which the sheet, when engaged at only two registration edges, can be considered to be turning with pure rotation to cause engagement of a third registration edge with an opposed flat on one of the pins. For example, were registration edge 16' to be slightly out of engagement with its otherwise opposite land on hex pin 11' the sheet, under the spring force of flap 15', would tend to rotate about a point comprising the center of hex pin 11 to return registration edge 16' into engagement with its opposed land on hex pin 11' This point comprises an instantaneous center of rotation for the two registration edge elements 16 and 17 and is determined by the intersection of their respective perpendiculars as shown by dashed-dotted lines 18–19. Any two registration edge elements are associated with a respective instantaneous center of rotation about which pure rotation can be considered to occur were the third registration edge element to be slightly displaced from its opposing flat on the hex pin. Parallel dash-dotted lines 19, 19' define an instantaneous center of rotation at infinity. Dash-dotted lines 18 and 19' intersect at a point (not shown) outside the sheet, but which point nevertheless is well displaced from another instantaneous center of rotation at the center of hex pin 11. The separation of these centers of rotation provides a stability to the registration of the sheet in that there is a tendency for the sheet to return to its original registered position when subjected to a temporary unbalanced force causing one of the registration edges to leave contact with its corresponding flat on the hex pin.

Figure 3:
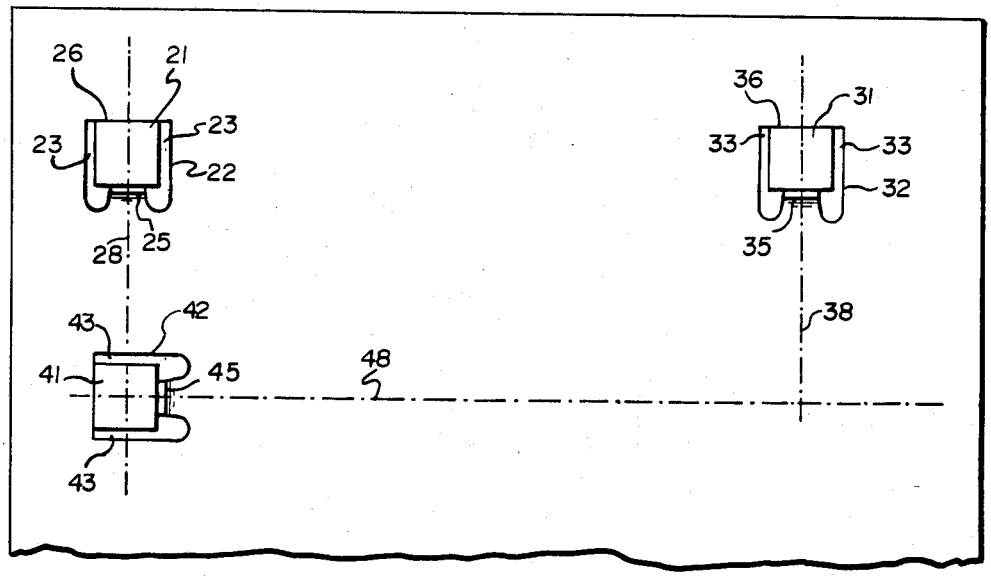
FIG. 3 is a plan view of a second embodiment of the invention illustrating a sheet registered by three pins in a condition of exact constraint.

With reference now to the alternate embodiment disclosed in FIG. 3 rectangular pins 21, 31 and 41 serve to register sheet 20 which includes three "C" shaped apertures 22, 32, and 42 through which a respective rectangular pin extends. Registration edges 26, 36 and 46 border their respective apertures and each engage an opposing flat formed on the respective pin. Clearances 23, 33 and 43 are provided between other bordering edges of each aperture and the respective pins. Resilient flaps 25, 35 and 45 formed in the sheet engage respective pins to bias the three registration edges into engagement with the pins. The condition for exact constraint is met in providing for only three edge elements of the sheet being in engagement with the locating pins. In addition the instantaneous centers of rotation as defined by the intersections of dash-dotted lines 28, 38 and 48 are well separated.

Figure 4:
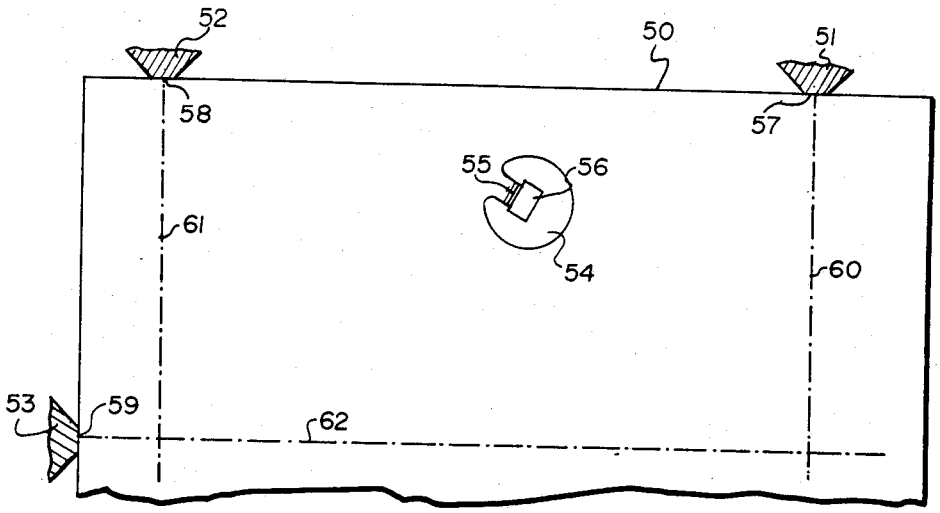
FIGS. 4 and 5 are plan views of third and fourth embodiments of the invention each showing a sheet registered in a condition of exact constraint.

In the embodiment shown in FIG. 4, a sheet 50 is registered in a condition of exact constraint by three locating means or pins 51, 52 and 53 fixed to the planar surface in which the sheet is to be registered. Registration edge elements 57, 58 and 59 of the sheet comprise two of the external edges of the sheet. The registration edge elements 57, 58 and 59 are resiliently biased against pins 51, 52 and 53 respectively by cooperation of resilient flap 55, formed in the sheet 50 adjacent to aperture 54, and member 56 which is fixed relative to the aforesaid planar surface. Member 56 may comprise a rectangular or other shaped pin that extends from the surface and through aperture 54 and provides a land against which the resilient flap may resiliently rest to push the three registration edge elements of the sheet into engagement with the registration pins. It will be noted that the instantaneous centers of rotation for this registration means, defined by the intersections of dash dotted lines 60, 61, and 62 are well separated.

Figure 5:
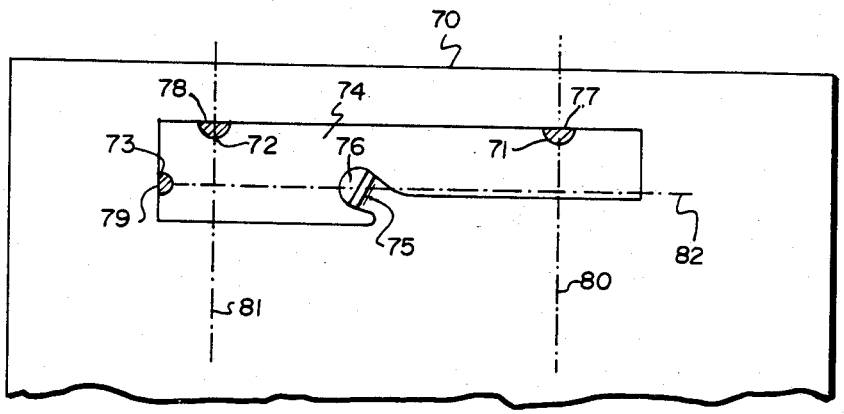

In the embodiment shown in FIG. 5 a sheet 70 is registered in a condition of exact constraint by three registration aids or pins 71, 72 and 73 fixed to the planar surface in which the sheet is to be registered. Registration edge elements 77, 78 and 79 of the sheet comprise edges which border an aperture 74 formed in the sheet. The registration edge elements 77, 78 and 79 are resiliently biased against pins 71, 72 and 73 respectively by cooperation of resilient flap 75, formed adjacent aperture 74, and member 76 which is fixed relative to the aforesaid planar surface. Member 76 may comprise a pin that extends from the surface and through aperture 74 and provides a land against which the resilient flap may resiliently rest to pull the three registration edge elements of the sheet into engagement with the registration pins. The instantaneous centers of rotation for this registration means, as defined by the intersections of dash dotted lines 80, 81 and 82 are also well separated.

Other modifications may include a sheet having only one "A" perforation as shown in FIG. 1 and one other registration edge comprising a natural edge of the sheet, assuming means, such as gravity, is provided to bias the edge against a corresponding locating aid and that the centers of rotation are well separated and only three edge elements are being engaged.

The sheet may comprise paper such as plain paper or coated papers such as photographic papers or the sheet may be comprised of other materials consistent with the spirit of the invention.

The invention has been described in detail with particular reference to preferred embodiments thereof, but it will be understood that variations and modifications can be affected within the spirit and scope of the invention.

I claim:

1. In a sheet registration means including locating means associated with a plane in combination with registration edge elements on a sheet for registering the sheet in the plane, the sheet having one or more flaps formed on the sheet; and the improvement which comprises:

wherein the one or more flaps cooperate with means external to the sheet for resiliently biasing a total of only three registration edge elements of the sheet against the locating means and wherein the registration edge elements are so oriented relative to each other as to form well separated centers of rotation.

2. The sheet registration means of claim 1 wherein the sheet has two apertures formed therein, one aperture having two converging edges which border the aperture and comprise two registration edge elements, and the other aperture having one edge which borders its respective aperture and comprises one registration edge element; and wherein a flap is formed in the sheet adjacent each aperture.

3. The sheet registration means of claim 1 wherein the sheet has three apertures formed therein with each aperture having one edge which borders its respective aperture comprising a registration edge element; and wherein flaps are formed in the sheet and border each of the three apertures.

4. The sheet registration means of claim 1 wherein the sheet has one aperture formed therein and wherein a flap is formed on the sheet and biases three registration edge elements, on external edges of the sheet, against the locating means.

5. The sheet registration means of claim 1 wherein the sheet has one aperture formed therein and wherein a flap is formed on the sheet and biases three registration edge elements, which border the said aperture, against the locating means.

* * * * *